United States Patent [19]

Durì

[11] Patent Number: 4,711,340

[45] Date of Patent: Dec. 8, 1987

[54] DEVICE TO DISCHARGE ROLLED PRODUCTS ONTO A COOLING PLATE, CLOSURE OF THE DEVICE TAKING PLACE BY POSITIVE ACTUATION

[75] Inventor: Antonino Durì, Pradamano, Italy

[73] Assignee: Danieli & C. Officine Meccaniche SpA, Italy

[21] Appl. No.: 824,580

[22] Filed: Jan. 23, 1986

[30] Foreign Application Priority Data

Jan. 23, 1985 [IT] Italy ..... 83320 A/85

[51] Int. Cl.[4] ..... B21B 43/12

[52] U.S. Cl. ..... 198/451; 198/452; 198/468.6; 414/748

[58] Field of Search ..... 198/448, 451, 452, 457, 198/463.3, 468.6; 414/748; 221/263, 266

[56] References Cited

U.S. PATENT DOCUMENTS 4,448,298 5/1984 Matsuo ..... 198/451

FOREIGN PATENT DOCUMENTS 746228 7/1970 Belgium ..... 414/748

114791 1/1984 European Pat. Off. ..... 414/748

*Primary Examiner*—Andres Kashnikow

*Attorney, Agent, or Firm*—Wegner & Bretschneider

[57] ABSTRACT

A device for discharging rolled products onto a cooling plate. The device, which cooperates with a tail-brake for braking the discharging rolled products, includes two channels with movable vanes which are selectively opened and closed to selectively release rolled products from the channels. The vanes of both channels are opened and closed by a common actuator system. Closure of the vanes is achieved by positive actuation while opening of the vanes is effected by gravity upon release of the vanes by the actuation system.

9 Claims, 2 Drawing Figures

DEVICE TO DISCHARGE ROLLED PRODUCTS ONTO A COOLING PLATE, CLOSURE OF THE DEVICE TAKING PLACE BY POSITIVE ACTUATION

FIELD OF THE INVENTION

This invention concerns a device to discharge rolled products onto a cooling plate, closure of the device taking place by positive actuation. To be more exact, the invention concerns a device to discharge rolled products onto a cooling plate, the device being of a type which comprises two channels to accommodate the rolled products and in which, after braking has been performed by a tail-brake, such discharge onto the plate takes place by means of the downward opening of such channels.

DESCRIPTION OF RELATED ART

Various types of devices are known which cooperate with tail-brakes or in which the braking takes place by friction within the channels themselves.

To perform the discharge of the rolled bars onto the cooling plate after they have been braked, some known devices provide a sideways opening of the channels, for instance by displacement of vanes which form the side covering of the channels.

Such known devices with two channels entail the drawback of including separate actuation means for the vanes of the two channels.

In general, such actuation means consist of two independent shafts with cams or arms to actuate the respective vanes.

Such embodiments are therefore heavy, bulky and costly owing to the double actuation system.

Patent NL-A-7.011.686 is also known and discloses a device with two braking channels in which the braking vanes form the side portion and bottom of the channels.

Opening is caused by cams arranged along one single shaft line.

This NL patent provides a positive drive to open the vanes, which normally remain closed owing to gravity and are opened by the positive action of the cams. It should be noted that in this device, when the bars have been released, they fall sharply onto a cooling plate.

EP-A-0114791 filed in the name of the present applicant is known and discloses a device with vanes forming the side portion of the channel and with a positive drive for opening the channel. In this device the braking of the bars takes place by means of a component of the weight of the vanes, such component constraining the bar itself against a stationary surface.

Patent GB-A-2,066,123 discloses a system to brake and discharge the bar with rotary channels.

SUMMARY OF THE INVENTION

The device of the present invention provides for the employment of two parallel channels, the vanes of either channel being disposed in such a way as to permit their actuation by cams positioned along the line of one single shaft.

Unlike the known art, the invention also arranges for discharge of the rolled products onto the cooling plate by means of the opening of the bottom of the channels in which such rolled products run.

According to the invention the closure of the bottom of the channels is performed by positive actuation, whereas their opening can take place through the force of gravity as soon as the vanes have been released by the actuation cams.

In this way the actuation of the alternative opening of the bottom of one or the other channel is obtained by disengagement of the cams from the vanes by means of the actuation of such cams by one single shaft line. The actuation cams comprise a suitable reciprocal timed arrangement.

This invention is therefore embodied in a device to discharge rolled products onto a cooling plate, the device cooperating with tail-brake means and including two channels with movable vanes capable of being opened and closed, and also including means to actuate such vanes, the device being characterized in that the vanes of either channel are actuated by a common actuation system, their closure being obtained by positive actuation.

BRIEF DESCRIPTION OF THE DRAWINGS

We shall now describe a preferred embodiment of this invention as a non-restrictive example with the help of the attached figures, in which.

DESCRIPTION OF THE PREFERRED EMBODIMENT

Figure 1:
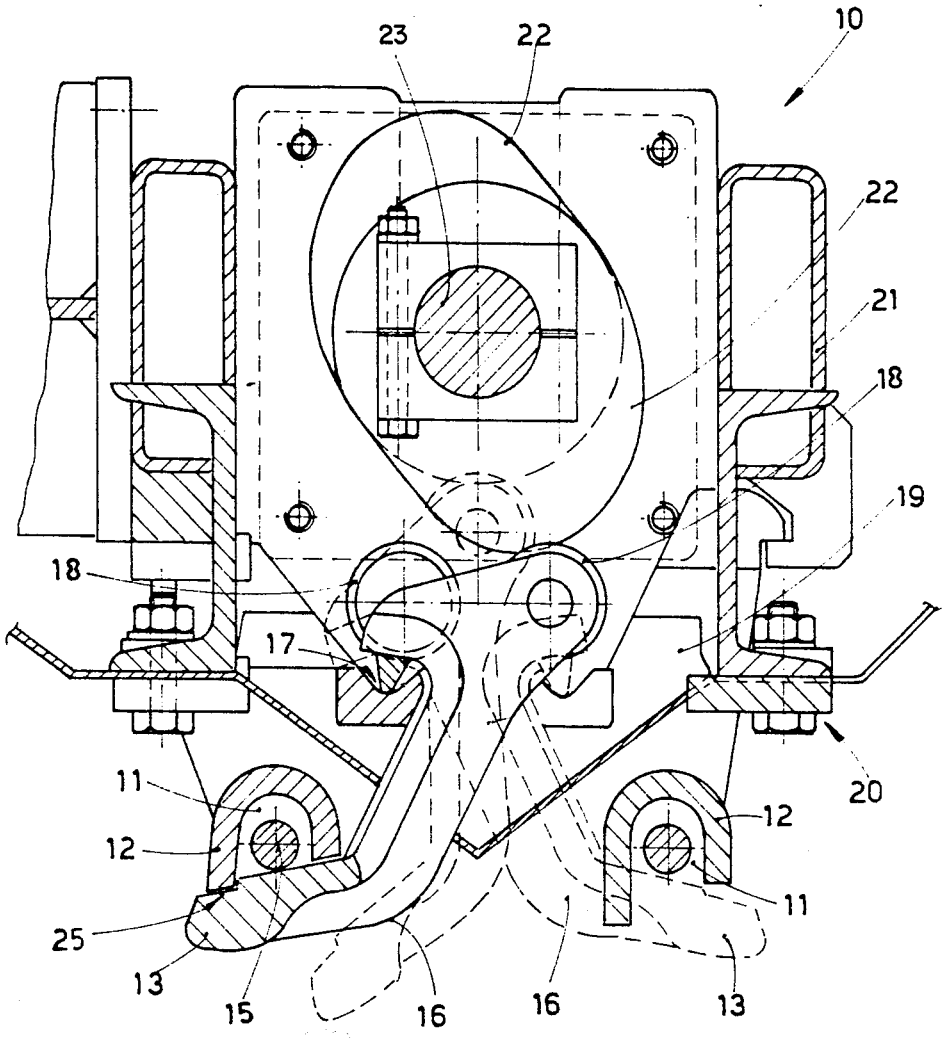
FIG. 1 shows a cross-sectional view of a device with two channels to discharge rolled products onto a cooling plate according to a first embodiment of the present invention.

In FIG. 1 a device 10 comprises in this example two channels 11 having a parallel walls, within which runs a bar 15 that is braked by a tail-brake, which is not shown here but can be of any type, such system being widely known in the art.

Each of the channels 11 is defined by a stationary upper portion 12 conformed tunnel-wise and by a movable bottom consisting of movable vanes 13.

The movable vanes 13, positioned in succession, constitute a substantially continuous bottom of the channels 11.

Each vane 13 is solidly fixed to an arm 16 pivoted at 17. In this case the arm 16 is pivoted by means of a knife-edge articulation.

This system is the simplest solution as regards embodiment and simplicity of maintenance and/or replacement of the knife blade.

Each arm 16 comprises a cam follower 18 consisting of a roller and cooperating momentarily with a cam 22.

As can be seen, the rollers 18 of arms 16 for either channel 11 are arranged alternately and are actuated by suitably timed cams 22 forming the head of one single shaft line 23.

In this way both the series of vanes 13 of both channels 11 are actuated by the one single shaft 23.

As can be seen in the example shown, the cams 22 actuate the closure of the vanes 13 positively, whereas the vanes 13 are opened by the force of gravity.

The vanes 13 are supported by a carrying element 19 through the knife-edge articulation 17.

The element 19 is connected in this example by a bolted connection 20 to a stationary frame 21, which can be supported in any known way along the discharge line.

In the embodiment of FIG. 1 the vane 13 comprises a stepped seating 25 for better cooperation with the stationary portion 12 which defines the channel 11.

In such embodiment the vane 13 leaves the bottom of the channel 11 almost completely free when the vane is lowered.

The rolled bar 15 is therefore substantially discharged by falling onto a cooling plate, which is not shown here but is positioned immediately below the channel 11.

Figure 2:
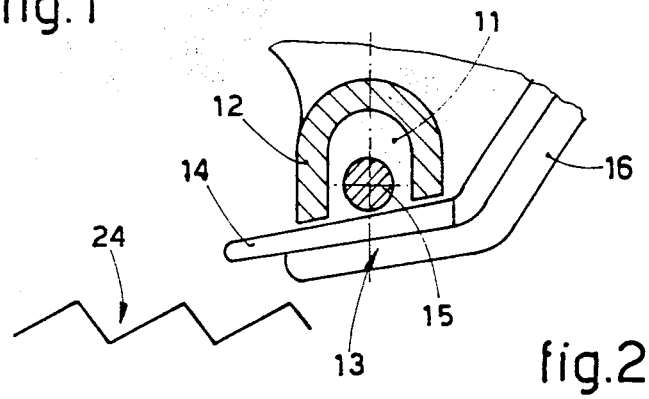
FIG. 2 gives a detail of a second embodiment of the present invention.

In the embodiment of FIG. 2 the vane 13 comprises an end chute portion 14 which serves, for example, to deposit the bar 15 by sideways sliding onto a cooling plate 24.

This embodiment serves in particular to discharge structural sections onto the cooling plate 24 without their being overturned.

It is clear that according to the invention other conformations of the vanes 13 are possible for instance variously curved conformations to suit the method of falling which is to be imparted to the bar 15 could be provided.

Moreover, the angle formed between the horizontal and the vane 13 in its closed or opened position may be determined to suit the type of fall to be imparted to the bar 15.

Many other variants are possible without departing from the scope of the invention. For instance, it will be possible to provide for a joint system 17 other than that shown, by making use of pivots and loops, for example, or else it will be possible to have a system to actuate the vanes 13 other than the system shown with cams 22 and cam followers 18.

These and other variants are all possible within the scope of the invention.

What is claimed is:

1. An apparatus cooperating with a tail-brake means for discharging rolled products onto a cooling plate, comprising:

at least two channels with bottoms which comprise movable vanes capable of being opened and closed; and a common actuating means having operable contacting cams for actuating the vanes of said at least two channels to selectively open and close said vanes, the closure and opening of said vanes being achieved by positive actuation and gravity, respectively.

2. An apparatus in accordance with claim 1 wherein said common actuating means comprises a single shaft with said cams cooperating at least momentarily with cam followers of the vanes, each vane is coupled to an arm having at least one of said cam followers.

3. An apparatus in accordance with claim 1, wherein the bottoms of said channels are open when said vanes are in the opened position.

4. An apparatus in accordance with claim 2, wherein said bottoms of said channels are open when the vanes are in the opened position.

5. An apparatus in accordance with claim 1, wherein the vanes, in the opened position, form a chute for the rolled products.

6. An apparatus in accordance with claim 2, wherein the vanes, in the opened position, form a chute for the rolled products.

7. An apparatus in accordance with claim 3, wherein the vanes, in the opened position, form a chute for the rolled products.

8. An apparatus in accordance with claim 4, wherein the vanes, in the opened position, form a chute for the rolled products.

9. An apparatus in accordance with claim 5, wherein the vanes, in the opened position, form a chute for the rolled products.

* * * * *